US008931561B2

(12) United States Patent
Baker et al.

(10) Patent No.: US 8,931,561 B2
(45) Date of Patent: Jan. 13, 2015

(54) SOFT LANDING SYSTEM AND METHOD OF ACHIEVING SAME

(75) Inventors: Ronald Baker, Spring, TX (US); Pradeep Dhuper, Spring, TX (US)

(73) Assignee: Vetco Gray Inc., Houston, TX (US)

( * ) Notice: Subject to any disclaimer, the term of this patent is extended or adjusted under 35 U.S.C. 154(b) by 524 days.

(21) Appl. No.: 13/277,395

(22) Filed: Oct. 20, 2011

(65) Prior Publication Data

US 2013/0098626 A1 Apr. 25, 2013

(51) Int. Cl.
*E21B 7/12* (2006.01)
*E21B 19/00* (2006.01)
*E21B 41/10* (2006.01)

(52) U.S. Cl.
CPC ..... *E21B 19/002* (2013.01); *E21B 41/10* (2013.01)
USPC ..... 166/341; 166/360; 166/368; 166/378

(58) Field of Classification Search
USPC ..... 166/341, 360, 368, 378, 85.1
See application file for complete search history.

(56) References Cited

U.S. PATENT DOCUMENTS 3,358,753 A 12/1967 Haeber
3,493,043 A * 2/1970 Watkins ..... 166/341
3,551,005 A * 12/1970 Brun ..... 285/10
3,572,044 A * 3/1971 Pogonowski ..... 405/204
3,603,386 A * 9/1971 Talley, Jr. ..... 166/351
3,603,409 A * 9/1971 Watkins ..... 175/7
3,612,177 A * 10/1971 Gassett et al. ..... 166/337
3,633,667 A * 1/1972 Falkner, Jr. ..... 166/366
3,643,736 A * 2/1972 Talley, Jr. ..... 166/356
3,670,814 A * 6/1972 Childers ..... 166/337
3,672,177 A * 6/1972 Manning ..... 405/227
3,678,996 A * 7/1972 Herd ..... 166/368
3,710,859 A * 1/1973 Hanes et al. ..... 166/339
3,770,052 A * 11/1973 Childers ..... 166/351
3,866,677 A * 2/1975 Baugh ..... 166/336
3,924,446 A * 12/1975 Baugh ..... 73/37
3,968,838 A * 7/1976 Baugh ..... 166/347
4,036,295 A * 7/1977 Kirkland et al. ..... 166/342
4,095,649 A * 6/1978 Chateau et al. ..... 166/351
4,120,171 A * 10/1978 Chateau et al. ..... 405/169
4,154,552 A * 5/1979 VAN Bilderbeek ..... 405/229
4,167,215 A * 9/1979 Thorne ..... 166/341

(Continued)

FOREIGN PATENT DOCUMENTS

WO 2005016581 A2 2/2005

OTHER PUBLICATIONS

Search Report dated Dec. 28, 2012 from corresponding Application No. GB1218719.1.

*Primary Examiner* — Matthew Buck
*Assistant Examiner* — Aaron Lembo
(74) *Attorney, Agent, or Firm* — Bracewell & Giuliani LLP

(57) ABSTRACT

A subsea wireline system for soft landing equipment during installation. The subsea soft landing wireline system includes coarse alignment members that can be part of a tree and interact with a funnel located on the equipment to be installed by the soft landing system. Smaller alignment members can provide fine alignment and also interact with a funnel located on the equipment to be installed. The funnels are used to trap sea water that provides a cushion for the equipment being installed. Once in alignment, trapped water can be released from the funnel or funnels via a restricted orifice and/or a control valve located on an ROV. The system achieves soft landing without the use of a running tool, thus reducing expense.

20 Claims, 7 Drawing Sheets

(56) References Cited

U.S. PATENT DOCUMENTS

| | | | | | |
|---|---|---|---|---|---|
| 4,171,922 | A | * | 10/1979 | Coulboy et al. | 405/169 |
| 4,191,256 | A | | 3/1980 | Croy et al. | |
| 4,281,716 | A | * | 8/1981 | Hall | 166/339 |
| 4,387,771 | A | * | 6/1983 | Jones | 166/341 |
| 4,399,872 | A | * | 8/1983 | McConaughy et al. | 166/341 |
| 4,544,036 | A | * | 10/1985 | Saliger | 166/341 |
| 4,591,296 | A | * | 5/1986 | Henderson et al. | 405/195.1 |
| 4,635,728 | A | * | 1/1987 | Harrington | 166/341 |
| 4,695,190 | A | | 9/1987 | Best et al. | |
| 4,702,320 | A | * | 10/1987 | Gano et al. | 166/343 |
| 5,046,376 | A | * | 9/1991 | Baker | 74/89.39 |
| 5,158,141 | A | * | 10/1992 | Saliger et al. | 166/341 |
| 5,209,673 | A | * | 5/1993 | Mohn et al. | 439/199 |
| 6,022,421 | A | * | 2/2000 | Bath et al. | 134/8 |
| 6,267,419 | B1 | * | 7/2001 | Baker et al. | 285/364 |
| 6,516,876 | B1 | | 2/2003 | Jennings | |
| 6,581,691 | B1 | * | 6/2003 | Jennings et al. | 166/348 |
| 7,090,019 | B2 | * | 8/2006 | Barrow et al. | 166/361 |
| 7,398,822 | B2 | * | 7/2008 | Meijer et al. | 166/242.7 |
| 7,984,765 | B2 | * | 7/2011 | Askeland | 166/339 |
| 8,151,890 | B2 | * | 4/2012 | Spencer et al. | 166/352 |
| 2007/0227740 | A1 | * | 10/2007 | Fontenette et al. | 166/344 |
| 2009/0294129 | A1 | * | 12/2009 | Judge et al. | 166/341 |
| 2009/0294130 | A1 | * | 12/2009 | Rodriguez | 166/341 |
| 2009/0322074 | A1 | * | 12/2009 | Pallini et al. | 285/123.1 |

* cited by examiner

Fig. 6
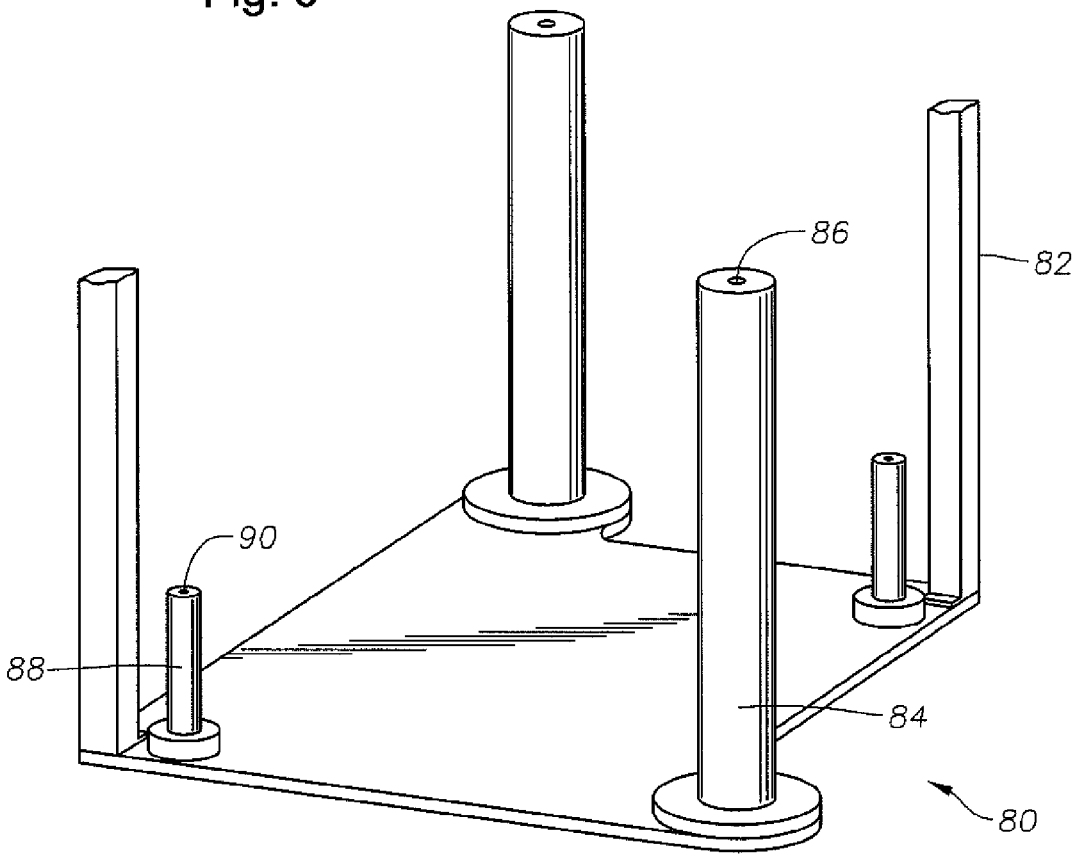
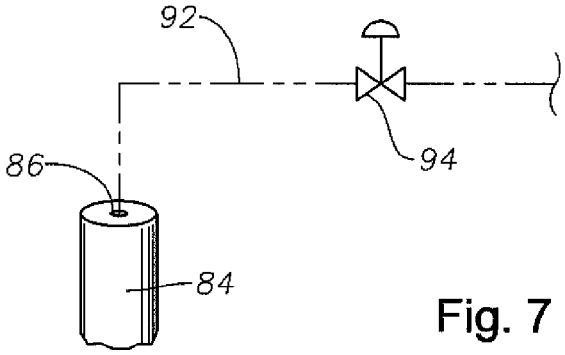
Fig. 7

SOFT LANDING SYSTEM AND METHOD OF ACHIEVING SAME

FIELD OF THE INVENTION

This invention relates in general to subsea wireline installed equipment, and in particular, a method of achieving a soft landing with subsea wireline installed equipment, without using a running tool.

BACKGROUND OF THE INVENTION

Typically, subsea equipment used in oil and gas applications must be lowered to a wellhead, a subsea equipment or system, such as a Christmas tree, or other site at the seabed. One type of subsea equipment that is lowered into the sea for installation may be a flow control module, for example. A flow control module is typically a preassembled package that may include a flow control valve and a production fluid connection that can mate with a hub on a subsea equipment or system, such as a Christmas tree. The hub on the Christmas tree may include a production fluid conduit to allow for the flow of production fluid from the well. The Christmas tree is typically mounted to a wellhead.

Typically, the flow control module may also include electrical and hydraulic connections as well as gaskets. The electrical and hydraulic connections may be used to control and serve components on the tree, such as valves. These connections or gaskets may be assembled on a flange of the production fluid connection for mating with corresponding connections on the tree hub. A stab and funnel system between the tree and flow package is typically used to align the production conduit and the several connections on the flow control package with those on the tree hub. Hard landing the flow control package on the tree may damage the connections at the hub, given the heavy weight of many equipment packages. To reduce the possibility of damage to the connections, the flow control module can be soft landed onto the tree. Soft landing is carried out by a running tool having a complex system of hydraulic cylinders and valves that slow the descent of the flow module package as it is landed onto the tree. However, the use of such soft landing running tools can be very expensive.

A need exists for a technique to achieve soft landing of subsea equipment without the use of a running tool.

SUMMARY OF THE INVENTION

In an embodiment of the invention, a soft landing wireline system utilized to install subsea equipment includes coarse alignment members or stabs and corresponding coarse alignment funnels, rings, or receptacles for guiding the coarse alignment members. Soft landing feature may be used on various types of subsea equipment or systems, including but not limited to manifolds, pipeline end manifolds (PLEMs), and pipeline end terminations (PLETs). Further, the soft landing wireline system could also be used in the installation of valves, actuators, chokes, and other components. The coarse alignment members may be part of a subsea equipment or system mounted on a wellhead and may interact with a funnel located on the equipment to be landed, such as a flow control module, to be installed by the soft landing subsea wireline system. The coarse alignment members and funnels provide general alignment of the equipment to be installed, preventing rotation of the equipment once at the subsea equipment or system. The subsea equipment or system.

In this embodiment, fine alignment members or stabs that are shorter and smaller in diameter than the coarse alignment members, provide fine alignment of the lowered equipment. Similar to the coarse alignment member, the fine alignment members may be part of the subsea equipment or system mounted to the wellhead. The fine alignment members may also interact with fine alignment funnels or receptacles that are located on the equipment to be installed. The fine alignment provides additional guiding of the equipment to facilitate mating of connections between the equipment and the subsea equipment or system.

Either or both of the coarse and fine alignment funnels may be used to trap sea water that can provide a cushion or resistance for the equipment being installed. The alignment members together with the alignment funnels create a type of piston and cylinder arrangement with the trapped water acting as the cushion. The size of the funnels may vary depending on the weight of the equipment and rate of descent. Larger equipment would require a larger cushion of sea water and thus a larger funnel. Once the equipment is in alignment, trapped water in the funnel can be released from the funnel via a restricted orifice or a control valve operated by a remotely operated vehicle (ROV). As the equipment settles and lands onto the subsea equipment such as a Christmas tree, the production fluid connection as well as electrical, hydraulic, and any other auxiliary connections or gaskets, mate with corresponding connections located at a hub of the subsea equipment. The possibility of damage to these connections or gaskets is advantageously minimized by the soft landing wireline system and achieves the soft landing of the subsea equipment without the use of a running tool, reducing associated expenses.

BRIEF DESCRIPTION OF THE DRAWINGS

FIG. 6, illustrates a partial perspective view of an embodiment of an equipment package for landing on subsea equipment of FIG. 1, in accordance with the invention;

FIG. 7, illustrates a perspective partial sectional view of an embodiment of funnel and stab used in soft landing, in accordance with the invention.

DETAILED DESCRIPTION OF THE INVENTION

Figure 1:
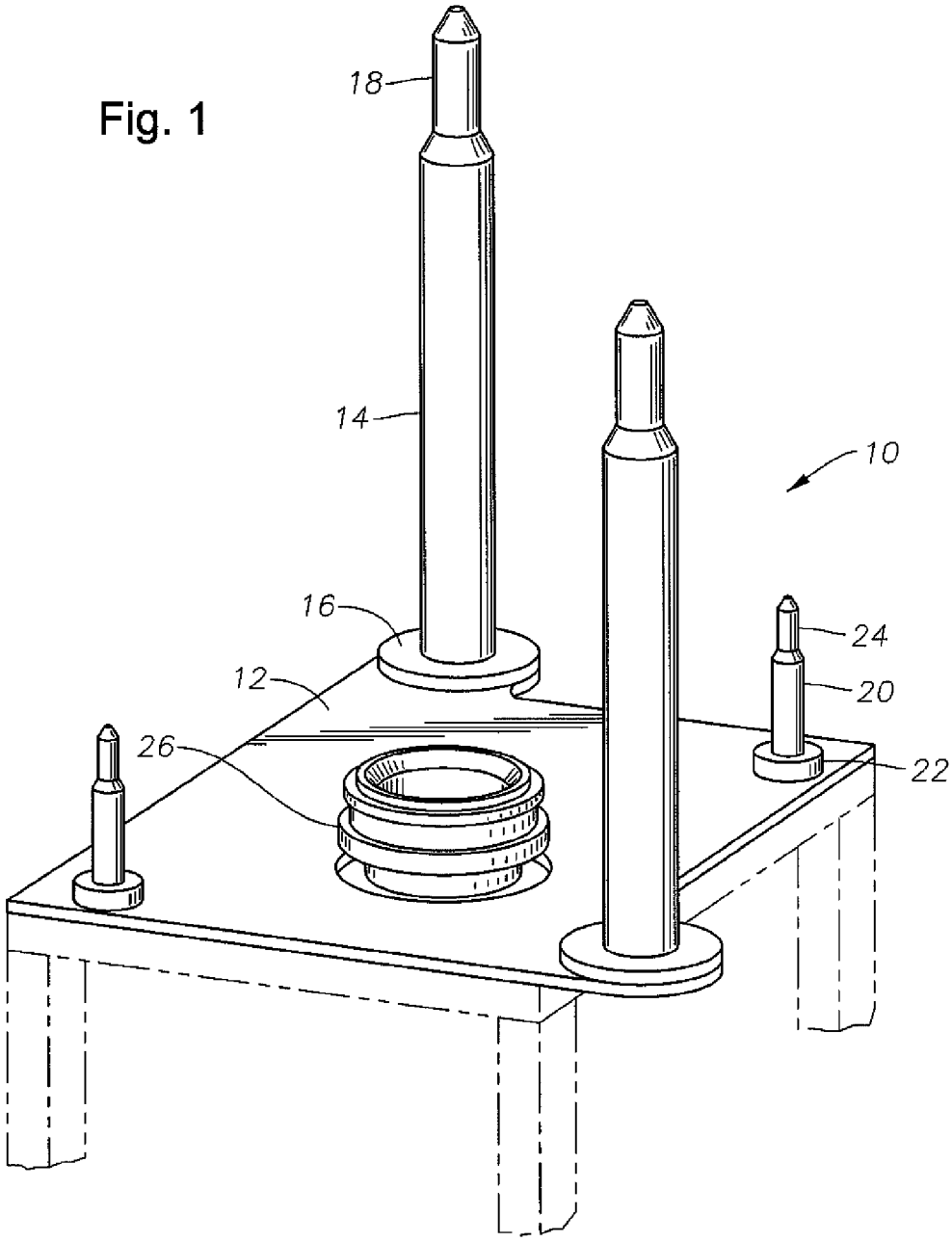
FIG. 1, illustrates a perspective view of an embodiment of a portion of a subsea equipment or system, in accordance with the invention.

FIG. 1 shows a perspective view of an embodiment of a portion of a subsea equipment or system 10, such as a Christmas tree, having a landing base or platform 12, that may be installed at a wellhead located at a seabed. In this embodiment, coarse alignment members or stabs 14 may be part of the subsea equipment 10 and may be mounted to the subsea equipment via a base 16. Coarse alignment members 14 may be used to provide general guidance or positioning for equipment being landed onto subsea equipment 10. Bolts (not shown) may be used to secure base 16 of the coarse alignment members 14 to the subsea equipment 10. A top end 18 of the coarse alignment member 14 may have a smaller diameter than the rest of the coarse alignment member. Top end 18 of the coarse alignment member 14 may have a conical shape. In this embodiment, the two coarse alignment members 14 are mounted on the subsea equipment 10 diagonally from each other. Diagonal mounting of coarse alignment members 14 helps prevent rotation of equipment being installed or landed on the subsea equipment 10.

Continuing to refer to FIG. 1, fine alignment members or stabs 20 may also be part of the subsea equipment 10 and may be mounted to the subsea equipment via a base 22. The fine alignment members 20 are smaller in length and diameter than the coarse alignment members 14 and fine tune positioning of equipment being landed on subsea equipment 10. The length of the coarse alignment members 14 will be longer than that of the fine alignment members 20 by a factor that can vary with the type of equipment package that is being landed and type of application. For example, the length of the coarse alignment member 14 may be from about 10 percent taller than the fine alignment member 20 to more than five times taller. Bolts (not shown) may be used to secure base 22 of the fine alignment members 20 to the subsea equipment 10. A top end 24 of the coarse alignment member 20 may have a smaller diameter than the rest of the fine alignment member. Top end 24 of the coarse alignment member 14 may have a conical shape. In this embodiment, the two coarse alignment members 14 are mounted on the subsea equipment 10 diagonally from each other. Thus, the coarse alignment members 14 and fine alignment members 20 may be alternatingly mounted at each corner of the landing platform 12. A hub 26 on the subsea equipment 10 is provided on the subsea equipment platform 12 for mating with equipment landed on the subsea equipment 10. Equipment landing will be explained further below.

Figure 2:
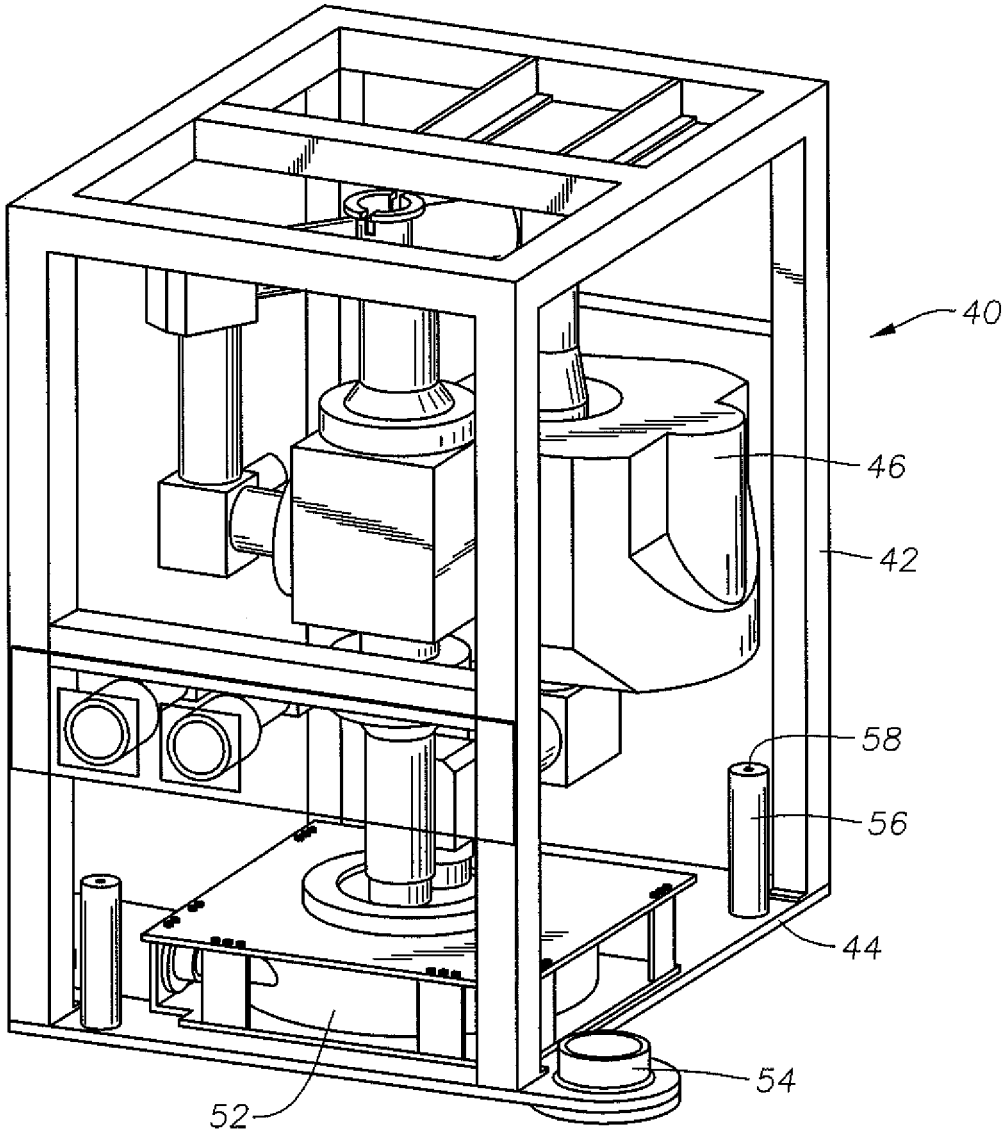
FIG. 2, illustrates a perspective view of an embodiment of an equipment package for landing on subsea equipment of FIG. 1, in accordance with the invention.

FIG. 2 shows a perspective view of an embodiment of a portion of an equipment package 40 having a frame 42 and a base 44, that may be landed on the subsea equipment 10 (FIG. 1). Equipment package 40 may be any type of subsea equipment or package lowered via wireline (not shown) to the previously installed subsea equipment 10, such as a Christmas tree (FIG. 1). For example, the equipment package 40 may be a flow control module that has a flow control device 46 that is in fluid communication with well once installed on subsea equipment 10 (FIG. 1). In this embodiment, equipment package 40 may have a generally central fluid connection 52 on which portions of the flow control device 46 may be mounted. Further, the fluid connection 52 may have a lower portion for mating with hub 26 (FIG. 1) located on the subsea equipment platform 12 (FIG. 1).

Continuing to refer to FIG. 2, a coarse alignment ring or receptacle 54 may be located at a corner of the base 44 of equipment package 40. In this embodiment, a second coarse alignment ring 54, obscured in view, may be located diagonally opposite from coarse alignment ring shown. Coarse alignment rings 54 interact with coarse alignment members 14 mounted on the subsea equipment 10 (FIG. 1) to provide general alignment of the equipment package 40 to be landed on the subsea equipment, preventing rotation of the equipment package once coarse alignment members 14 (FIG. 1) engage coarse alignment rings 54. Clearances between coarse alignment members 14 and coarse alignment ring or receptacle 54 may be around one inch to facilitate mating.

Continuing to refer to FIG. 2, a fine alignment funnel or receptacle 56 may be located at a corner of the base 44 of equipment package 40. In this embodiment, a second fine alignment funnel 56 may be located such that the equipment package 40 is balanced and oriented in a desired manner. For example, in this embodiment the second fine alignment funnel 56 is diagonally opposite from the other fine alignment receptacle shown. Fine alignment funnel 56 interacts with fine alignment members 20 mounted on the subsea equipment 10 (FIG. 1) to provide additional guiding of the equipment package 40 once coarse alignment is achieved and the equipment package continues moving downward towards landing platform 12 of subsea equipment 10 (FIG. 1). Clearance between the fine alignment members 20 and fine alignment receptacle 56 is smaller than for coarse alignment to allow for more precise orientation. Fine alignment facilitates mating of connections (not shown), such as production, hydraulic, and/or electrical, or gaskets, between the equipment package 40 and the subsea equipment 10 (FIG. 1).

In addition to fine alignment, fine alignment funnel 56 may also facilitate soft landing of the equipment package 40. Trapped sea water in the fine alignment funnel 56 can provide a cushion or resistance for the equipment package being installed by wireline. Trapped sea water can be released via an orifice 58 at the closed top of funnel 56 that allows the trapped water to bleed out to the sea. Outer diameter of orifice 58 is smaller than bore diameter of fine alignment funnel 56. As the water is bled out from the fine alignment funnel 56, the equipment package 40 slowly lands on the landing platform 12 of the subsea equipment 10. Thus, soft landing of the equipment package 40 is achieved. As explained previously, soft landing feature may be used on various types of subsea equipment, including but not limited to manifolds, PLEMs, and PLETs. Further, the soft landing wireline system could also be used in the installation of valves, actuators, chokes, and other components. It is understood by one of ordinary skill in the art that installation of the alignment members and alignment funnels could be reversed such that the alignment members are part of the equipment package 40 to be landed and the alignment funnels are part of subsea equipment landing platform 12. The soft landing feature of the fine alignment funnel 56 is explained further below.

Figure 3:
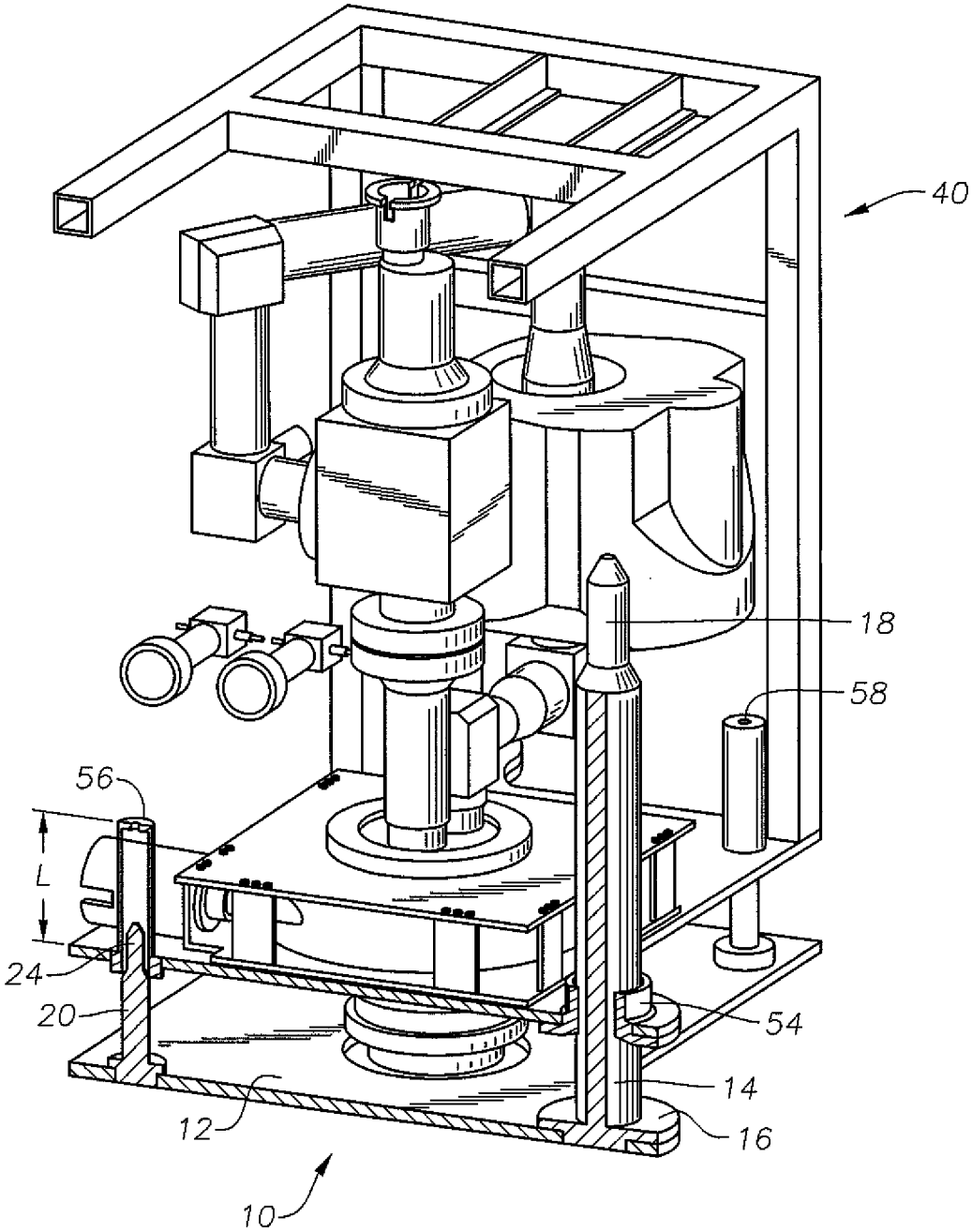
FIG. 3, illustrates a perspective partial sectional view of an embodiment of equipment package landing on the subsea equipment, in accordance with the invention.
Figure 3A:
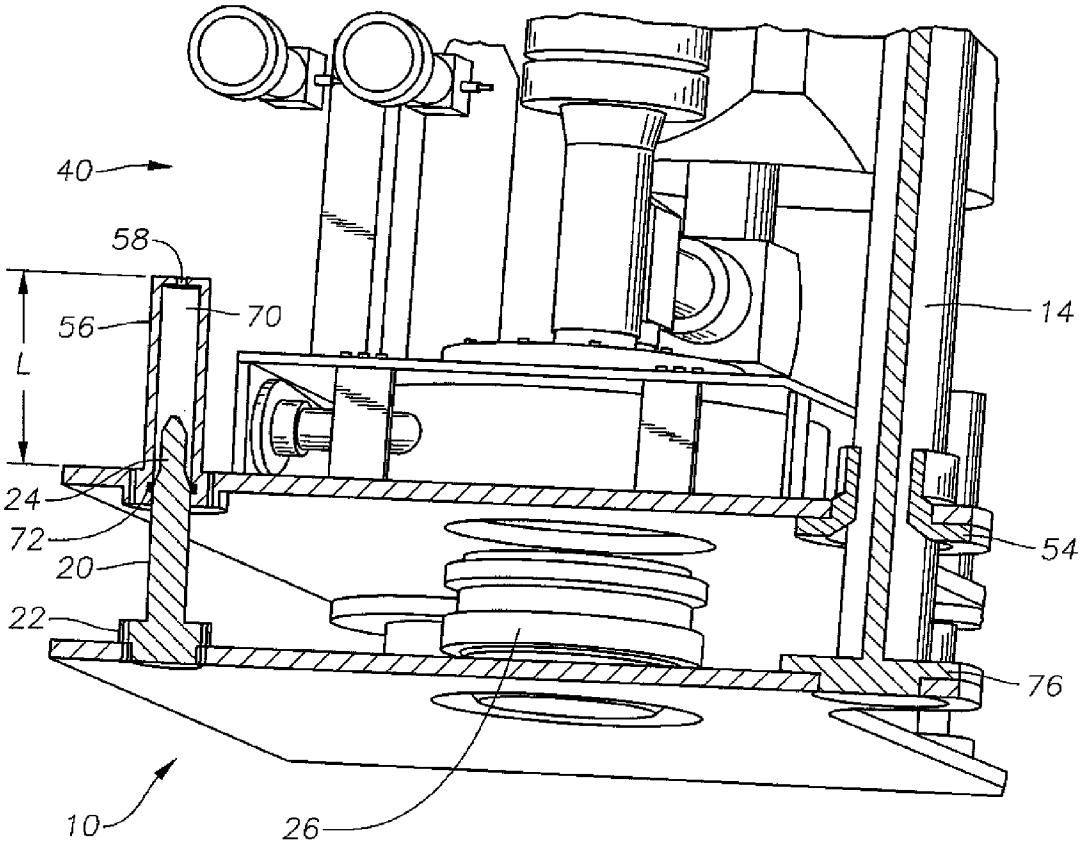
FIG. 3A, illustrates a lower perspective view of an embodiment of equipment package landing on the subsea equipment, in accordance with the invention.
Figure 4:
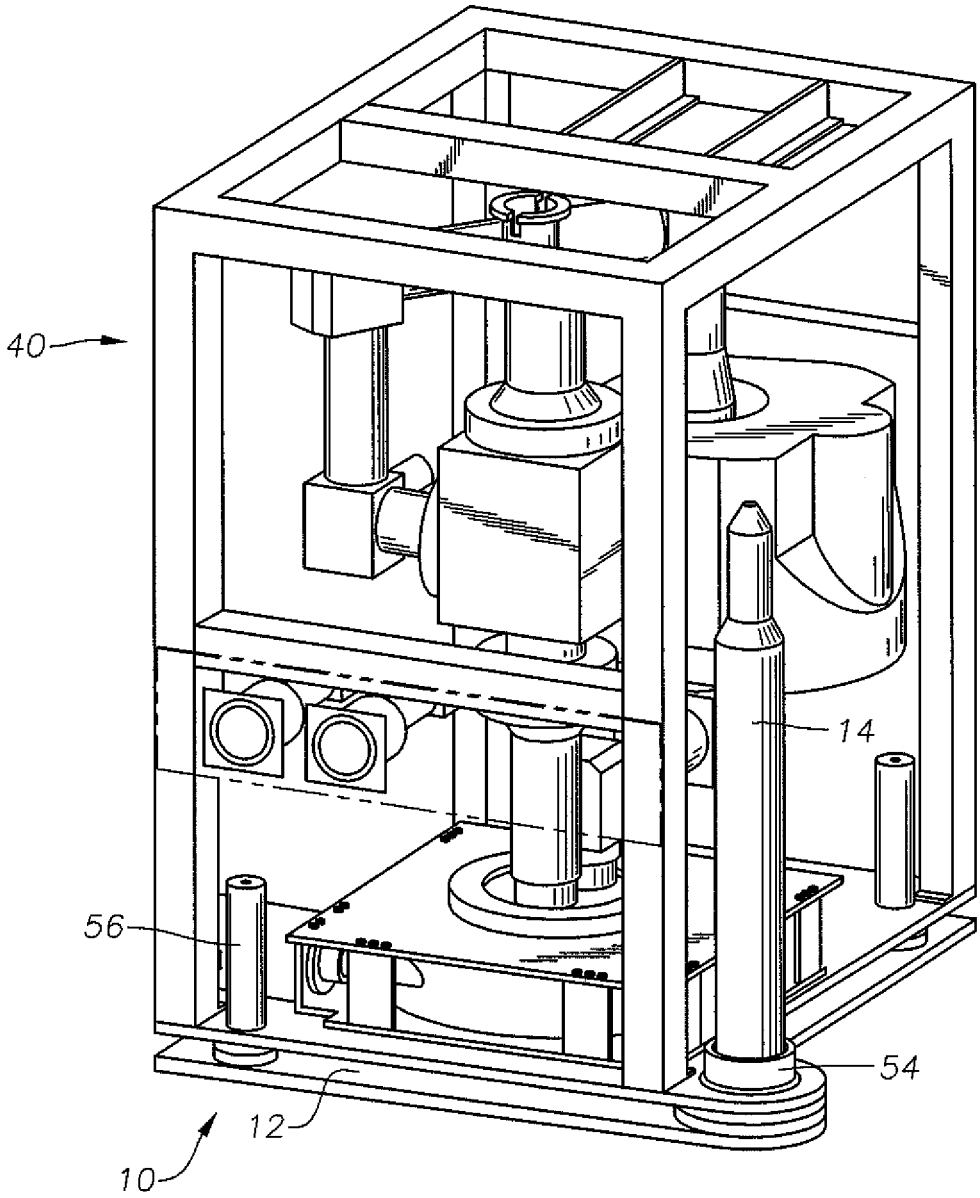
FIG. 4, illustrates a perspective view of an embodiment of equipment package landed on the subsea equipment, in accordance with the invention.

In landing operation, illustrated in FIGS. 3-4, the equipment package 40 may be lowered to the subsea equipment 10 via wireline (not shown). Once coarse alignment ring 54 engages top end 18 of the coarse alignment members 14, the equipment package 40 continues to be lowered towards the landing base 12 of the subsea equipment 10. The interaction between the subsea equipment-mounted coarse alignment members 14 and the coarse alignment rings 54 prevents rotation of the equipment package 40. When equipment package 40 is lowered sufficiently, fine alignment funnels 56 engage a top end 24 of the fine alignment member 20, as shown in FIG. 3. Referring to FIG. 3A, a lower perspective illustration provides more clarity of the initial engagement of the fine alignment funnel 56 with the fine alignment member 20. A length L and an inner diameter of the fine alignment funnel 56 defines a chamber 70 within the fine alignment funnel. Sea water may be trapped in the chamber 70 of the fine alignment funnel 56 when the fine alignment member 20 enters a lower opening in the funnel. A sealing element 72 installed within the lower opening of the funnel facilitates the trapping of sea water within chamber 70.

Once the fine alignment member 20 engages the fine alignment funnel 56, the fluid connection 52 on the equipment package 40, any auxiliary connections (not shown), and gaskets (not shown) disposed on the fluid connection, are aligned to mate with hub 26 on the subsea equipment 10 and corresponding connections (not shown). Sea water trapped in chamber 70 may then be bled out to the sea at a desired rate from chamber 70 via orifice 58 to soft land the equipment package 40 onto the landing base 12 of subsea equipment 10, as shown in FIG. 4. Fine alignment member 20 together with fine alignment funnel 56, create a type of piston and cylinder arrangement with the trapped water in the chamber 70 acting as a cushion for the equipment package 40. Alignment funnels and members may vary in size depending on the weight of the equipment package and rate of descent. Larger equipment would require a larger cushion of sea water and thus a larger funnel. Soft landing of the equipment package 40 advantageously reduces the potential for damage during mating, to the hub 26, auxiliary connections such as electrical or hydraulic connections, or gaskets. Further, during removal of equipment package 40 from the landing base 12, the chamber 70 may self-charge with sea water to allow for any subsequent soft landings.

Figure 5:
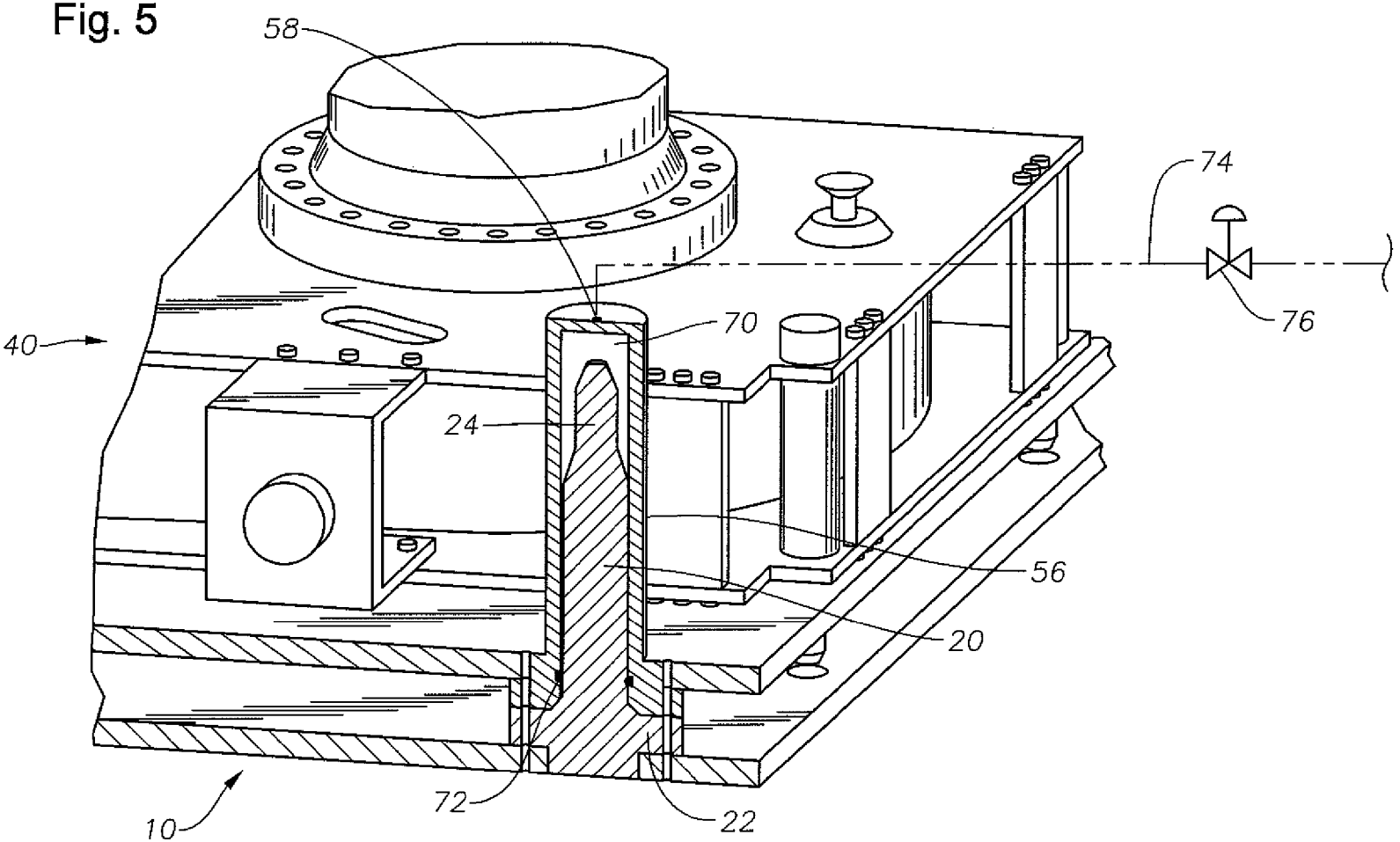
FIG. 5, illustrates a perspective partial sectional view of an embodiment of funnel and stab used in soft landing, in accordance with the invention.

In another embodiment illustrated in FIG. 5, orifice 58 may be connected to a line 74 and connected to a valve 76. The valve 76 may be located on a panel and operated by an ROV to allow sea water trapped within chamber 70 to bleed out into the sea at a desired rate and thereby allow soft landing of the equipment package 40 onto the subsea equipment 10.

In another embodiment illustrated in FIG. 6, an equipment package 80 may have a frame 82 as in a previously described embodiment. However, instead of coarse alignment rings the equipment package 80 may have coarse alignment funnels 84 mounted on a base of the package. As in previously described embodiment, coarse alignment funnels 84 may be mounted diagonally across from each other and facilitate general alignment of the equipment package 80 when lowered onto the subsea equipment 10 (FIG. 1). An orifice 86 may be located at an upper end of coarse alignment funnel 84 to allow trapped seawater within the funnel to bleed out during soft landing. As in a previous embodiment, fine alignment funnels 88 with an orifice 90 may also be mounted on the equipment package 80. This embodiment allows a larger volume of sea water to be trapped in the funnels 84, 88 for increased cushioning and thus softer landing, which may be utilized for heavier equipment. Alternatively, orifice 86 may be connected to connected to a line 92 and connected to a valve 94, as shown in FIG. 7. The valve 94 controls the bleed off rate to the sea. The valve 94 may be located on a panel and operated by an ROV to open line 92 to allow sea water trapped within coarse alignment funnel 84 to bleed out into the sea at a desired rate and thereby allow soft landing of the equipment package 80 onto the subsea equipment 10 (FIG. 1).

The invention is advantageous because it eliminates the cost of a soft landing running tool. Instead, the soft landing features are integrated onto a subsea equipment or system, and equipment package.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A subsea well system, comprising:

a subsea equipment adapted for mounting on a subsea wellhead;

an equipment package that lands on the subsea equipment;

a hub on the subsea equipment for mating with a corresponding connection on the equipment package to establish fluid communication between the equipment package and the subsea equipment;

a first alignment member carried by the equipment package and positioned to receive a corresponding second alignment member connected to the subsea equipment to thereby mate with the second alignment member when the equipment package is being landed on the subsea equipment to provide for establishing alignment of the equipment package with the subsea equipment when being landed thereupon;

a third alignment member carried by the equipment package and positioned to receive a corresponding fourth alignment member connected to the subsea equipment to thereby mate with the fourth alignment member when the equipment package is being landed on the subsea equipment to provide for further establishing alignment of the equipment package with the subsea equipment when being landed thereupon, the third alignment member comprising: a chamber for trapping sea water when the fourth alignment member enters an opening in an end of the third alignment member, and an orifice extending through a portion of the third alignment member; and a flow control valve in fluid communication with the sea water trapped within the chamber and configured to allow the sea water trapped within the chamber to be released at a desired rate to provide a soft landing of the equipment package onto the subsea equipment.

2. The system of claim 1, wherein the third alignment member is a receptacles; wherein the orifice is in fluid communication with the chamber; and wherein the flow control valve is further in fluid communication with the sea to allow the sea water trapped in the chamber to bleed out to the sea at the desired rate.

3. The system of claim 1, wherein the third alignment member is a receptacle connected to the flow control valve; and wherein the flow control valve is configured to be remotely operated by a remote operating vehicle (ROV) to allow the sea water trapped in the chamber to be released out to the sea at the desired rate.

4. The system of claim 1, wherein the second alignment member has a length selected so that the second alignment member mates with the first alignment member before the fourth alignment member mates with the third alignment member.

5. The system of claim 4, wherein:

an inner diameter of the first alignment member is larger than an inner diameter of the third alignment member;

an outer diameter of the second alignment member is larger than an outer diameter of the fourth alignment member.

6. The system of claim 1, wherein the fourth alignment member is mounted to the subsea equipment, the third alignment member mounted to the equipment package; and wherein the system further comprises a sealing element located adjacent the opening in the end of the third alignment member to facilitate trapping the sea water within the chamber of the third alignment member when mating the third alignment member with the fourth alignment member.

7. The system of claim 4, wherein the subsea equipment is one of the following:

a.) a Christmas tree;

b.) a manifold;

c.) a pipeline end manifold; or d.) a pipeline end termination.

8. The system of claim 1, wherein the first alignment member has a chamber for trapping sea water when the first alignment member mates with the second alignment member, as the equipment package is being landed on the subsea equipment.

9. The system of claim 8, wherein the first alignment member has an orifice in fluid communication with the chamber and to the sea to allow sea water trapped in the chamber to bleed out to the sea at a desired rate during landing of the equipment package.

10. The system of claim 8, wherein the first alignment member is connected to a flow control valve that is in fluid communication with the chamber and the sea to allow sea water trapped in the chamber to be released out to the sea at a desired rate during landing of the equipment package.

11. The system of claim 1, wherein each of the first, second, third, and fourth alignment members form part of an array of alignment members such that each of the alignment members are disposed diagonally across from an identical alignment member.

12. The system of claim 1, wherein the third alignment member is mounted on the equipment package and the second and fourth alignment members are pins mounted on the subsea equipment.

13. A subsea well system, comprising:

a subsea tree adapted for mounting on a subsea wellhead;

a flow control module that lands on the subsea tree;

a hub on the subsea tree for mating with a corresponding connection on the flow control module to establish fluid communication between the flow control module and the subsea tree;

a first alignment member mounted on the flow control module and configured to mate with a corresponding second alignment member mounted on the subsea tree, when the flow control module is being landed on the subsea tree to provide for establishing alignment of the flow control module with the subsea tree;

a third alignment member mounted on the flow control module configured to mate with a corresponding fourth alignment member mounted on the subsea tree, as the flow control module is being landed on the subsea tree to provide for further establishing alignment of the flow control module with the subsea tree, the third alignment member having a chamber for trapping sea water when the fourth alignment member enters an opening in a lower end of the third alignment member when the flow control module is being landed on the subsea tree, and an orifice at an upper end of the chamber to allow trapped sea water to be bled out of the chamber; and a flow control valve in fluid communication with the chamber via the orifice and configured to allow the trapped sea water to be released at a desired rate to provide a soft landing of the flow control valve onto the subsea tree, wherein the second alignment member has a length selected so that the first alignment member mates with the second alignment member before the third alignment member mates with the fourth alignment member;

an inner diameter of the first alignment member is larger than an inner diameter of the third alignment member; and an outer diameter of the second alignment member is larger than an outer diameter of the fourth alignment member.

14. The system of claim 13, wherein the hub is located on the subsea tree for mating with a corresponding connection on the flow control module to establish fluid communication between the flow control module and the subsea tree.

15. The system of claim 13, wherein the flow control valve is further in fluid communication with the sea to allow sea water trapped in the chamber to be released out to the sea at the desired rate.

16. The system of claim 13, wherein the first alignment member also has a chamber for trapping sea water as the second alignment member enters the first alignment member when the flow control module is being landed on the subsea tree, the first alignment member having an orifice in fluid communication with the chamber and to the sea to allow sea water trapped in the chamber to bleed out to the sea at a desired rate during landing of the flow control module.

17. The system of claim 16, wherein the flow control valve is a first flow control valve, and wherein the first alignment member is connected to a second flow control valve that is in fluid communication with the chamber of the first alignment member and the sea to allow sea water trapped in the chamber to be released out to the sea at the desired rate during landing of the flow control module.

18. The system of claim 13, further comprising a sealing element located between the third alignment member and the fourth alignment member to facilitate trapping of sea water as the third alignment member mates with the fourth alignment member.

19. A method for landing an equipment package on a subsea equipment, comprising:

providing an equipment package with a plurality of alignment members facing downward, and a subsea equipment with a plurality of alignment members facing upward, lowering the equipment package onto the subsea equipment and causing the alignment members of the subsea equipment to stab into the alignment members of the equipment package;

trapping sea water between at least one of the alignment members of the subsea equipment and a corresponding at least one of the alignment members of the equipment package as the at least one of alignment members of the subsea equipment stab into the corresponding at least one of alignment members of the equipment package, thereby slowing the downward movement of the equipment package with the trapped sea water; and releasing the sea water trapped between the at least one of the alignment members of the subsea equipment and at least one of the alignment members of the equipment package, at a desired rate to provide a soft landing of the equipment package onto the subsea equipment, the releasing performed through use of a flow control valve in fluid communication with the trapped sea water and configured to allow the sea water trapped within the chamber to be released at a desired rate.

20. The method of claim 19, wherein the flow control valve is further in fluid communication with the sea to allow the trapped sea water to bleed out to the sea at the desired rate.

* * * * *